United States Patent [19]

Krohn et al.

[11] Patent Number: 4,846,144

[45] Date of Patent: Jul. 11, 1989

[54] COOKING RANGE

[75] Inventors: Günter Krohn; Dietmar Kaselow, both of Hemer, Fed. Rep. of Germany

[73] Assignee: Cramer GmbH & Co. Kommanditgesellschaft, Menden, Fed. Rep. of Germany

[21] Appl. No.: 154,660

[22] Filed: Feb. 10, 1988

[30] Foreign Application Priority Data

Aug. 29, 1987 [DE] Fed: Rep. of Germany ..... 3728905

[51] Int. Cl.[4] ..... F24C 3/00

[52] U.S. Cl. ..... 126/39 G; 236/45; 126/1 F; 126/39 R; 126/39 H; 126/214 R; 126/290

[58] Field of Search ..... 236/45; 126/1 R, 1 F, 126/39 R, 39 B, 39 D, 39 H, 39 J, 39 K, 39 G, 289, 290, 292, 301, 214 R, 214 A, 214 B, 214 C

[56] References Cited

U.S. PATENT DOCUMENTS 4,270,894 6/1981 Moore et al. ..... 236/45 X
4,460,121 7/1984 Hedrick ..... 236/45 X

FOREIGN PATENT DOCUMENTS 1171551 6/1964 Fed. Rep. of Germany ..... 236/45
3715540 11/1988 Fed. Rep. of Germany .

*Primary Examiner*—Randall L. Green
*Attorney, Agent, or Firm*—Herbert Dubno

[57] ABSTRACT

The invention is concerned with a cooking range, especially suitable for mobile homes, which utilizes gas burners, where the exhaust gas draft is held substantially constant and the exhaust duct temperature is kept below a critical temperature by providing temperature-regulated cool air openings on the exhaust gas duct. Reliable regulation is accomplished by closures controlled by bimetallic springs positioned in a swivelable manner in the cool air openings so as to act on the closure flaps, and the closure action further improved by restoring springs exerting pressure on the outside of the closures.

8 Claims, 2 Drawing Sheets

COOKING RANGE

FIELD OF THE INVENTION

Our present invention relates to a cooking range which is especially suitable for mobile homes. More specifically, our invention relates to improvements in the exhaust gas system and means for producing a steady draft under a variety of cooking conditions, as well as means for avoiding overheating of the exhaust gas system.

BACKGROUND OF THE INVENTION

A range for use in mobile homes and recreation vehicles can comprise an enclosure, an intermediate floor covered by an insulating layer, gas burners, a glass ceramic cover plate and an exhaust gas duct with an opening to a chimney. The burners can be arranged on the intermediate floor and at some distance from the cover plate. The insulating layer can have gas conducting channels which are connected to the exhaust gas duct.

The exhaust gas channels can be connected to a corresponding number of chambers, as in German Patent Application No. P 37 15 540.7.

It will be understood that attached to the exhaust gas duct opening there will normally be an exhaust pipe leading to the outside or a chimney.

In the known cooking ranges of this type, undesirably high exhaust gas temperatures can occur in the exhaust gas duct. The high exhaust gas temperatures require very careful thermal insulation of the exhaust gas duct and moreover require special precautions against contact with combustible material or people in the vicinity of the exhaust pipe running to the outside or the chimney. The high gas temperatures also impose limits on the materials of construction which can be used. On the other hand, measures to reduce the exhaust gas temperature must not have an adverse effect on the draft in the exhaust gas duct or in the attached chimney. An adverse effect on draft leads to problems during the lighting and warming up phase of operation as well as when the burners are operated with a low flame.

OBJECTS OF THE INVENTION

The principle object of our invention is to provide a cooking range of the type described above, wherein the exhaust gas temperature can be reduced and kept below an acceptable maximum level, and without adversely affecting the draft during the ignition and heating up phases, while using easily constructed and reliable means.

SUMMARY OF THE INVENTION

This object is achieved by the present invention by providing the exhaust gas duct with a temperature controlled protective element, which at temperatures below the limiting temperature at which a sufficient draft is produced, a cool air opening in the exhaust gas duct is closed, and at temperatures above this limiting temperature, the cool air opening is opened to an extent depending on the temperature rise. A limiting temperature of about 80° C. has been established.

The exhaust gas duct of the invention is so arranged that fresh air can be admixed to a controlled degree with the exhaust gas. One effective and simple means for accomplishing this makes use of a closure element consisting of a bimetallic spring which covers the opening and is held at one end so that it can swivel.

However, the regulation which can be accomplished in this manner is not very good. Difficulties appear for the reason that the bimetallic spring at very low temperatures does not have sufficient freedom of movement, so that strains and deformations appear, which cause the opening characteristics of the spring to change.

In a preferred embodiment, therefore, the closure element is in the form of a closure flap, which covers obstructively the cool air opening, and which is attached in a swivelable manner to the outside of the exhaust gas duct, while in the cool air opening a bimetallic spring is swivelably positioned so as to be able to exert a pushing action on the closure flap.

It is preferred to have the bimetallic spring positioned in the exhaust gas duct swivelably and opposite to the closure flap. The bimetallic spring thus positioned in the exhaust gas duct affords very sensitive regulation and is not subjected at extreme temperatures to any stresses which could change its opening characteristics.

In order to avoid fluttering of the closure element by pressure variations, and to assure reliable closure by the closure element, it is further advantageous to position a restoring spring on the outside of the closure element. A simple spring metal strip, applying a slight pressure to the closure element, is sufficient. In general, it is advantageous to have the air inlet shaped as a slot. In this way, an elongated swivelable flap and correspondingly configured spring can be used.

It will be understood that a multiplicity of cool air openings with associated temperature control elements will be needed if the exhaust gas duct is constructed in accordance with German Patent Application No. P 37 15 540.7 and thus has a multiplicity of chambers to which the gas exhaust channels are connected. In this case, each chamber is advantageously constructed in accordance with the invention as described.

The velocity of the exhaust gases flowing into the exhaust gas duct is dependent on the opening characteristics of the closure elements and the geometry of the cool air openings. By determining the opening and flow characteristics, it is readily possible to establish a constant flow velocity in the exhaust gas duct. By having constant flow velocity, constant burning conditions can be established, which are advantageous for flame stability and cooking behavior. Simultaneously, a limitation on the maximum temperature of the exhaust gases can be achieved. Moreover, these advantages can be achieved by means which are easily constructed.

BRIEF DESCRIPTION OF THE DRAWING

The above objects, features and advantages of our invention will become more readily apparent from the following description, reference being made to the accompanying highly diagrammatic drawing in which.

SPECIFIC DESCRIPTION

Figure 1:
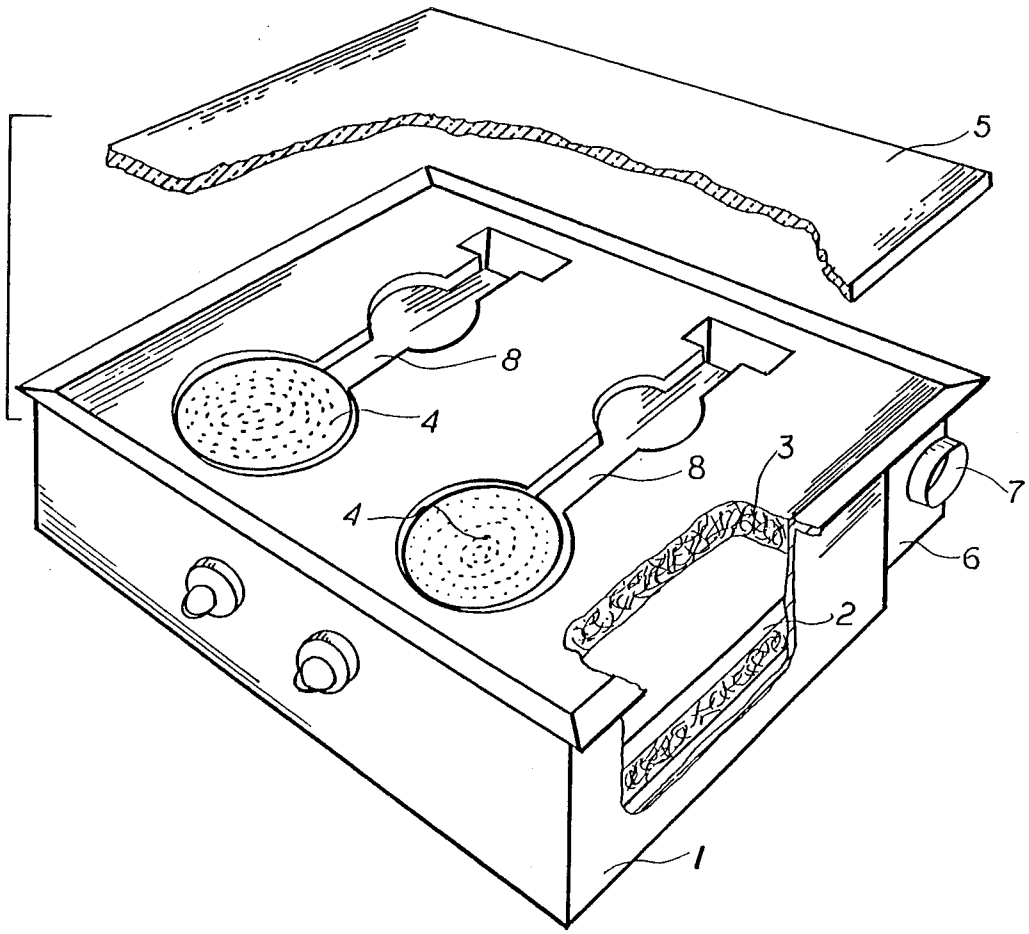
FIG. 1 is a diagrammatic perspective view, partly broken away, showing the basic construction of the cooking range according to the invention.

The cooking range shown in the drawing is especially designed for use in the kitchen area of a mobile home.

The basic components are a cooking range enclosure 1, with a thermal barrier layer 3 composed of mineral fiber, gas burners (with gas distributed through multiple apertures) 4, a cover plate 5 made of glass ceramic, and a exhaust gas duct 6 with a chimney attachment aperture 7, to which a chimney or an exterior exhaust pipe can be attached (FIG. 1).

The gas burners 4 are attached to the intermediate floor 2 and are placed at some distance from the cover plate 5.

The thermal barrier 3 has exhaust gas conduction channels 8 cut into it, these channels being connected to the exhaust gas duct 6.

The cover plate 5 is attached to the enclosure 1, and lies on the thermal barrier layer 3. In this way, the exhaust gas conduction channels are covered at the top. Within the scope of the invention, these exhaust gas conduction channels can be broadened to make extended cooking zones.

Figure 2:
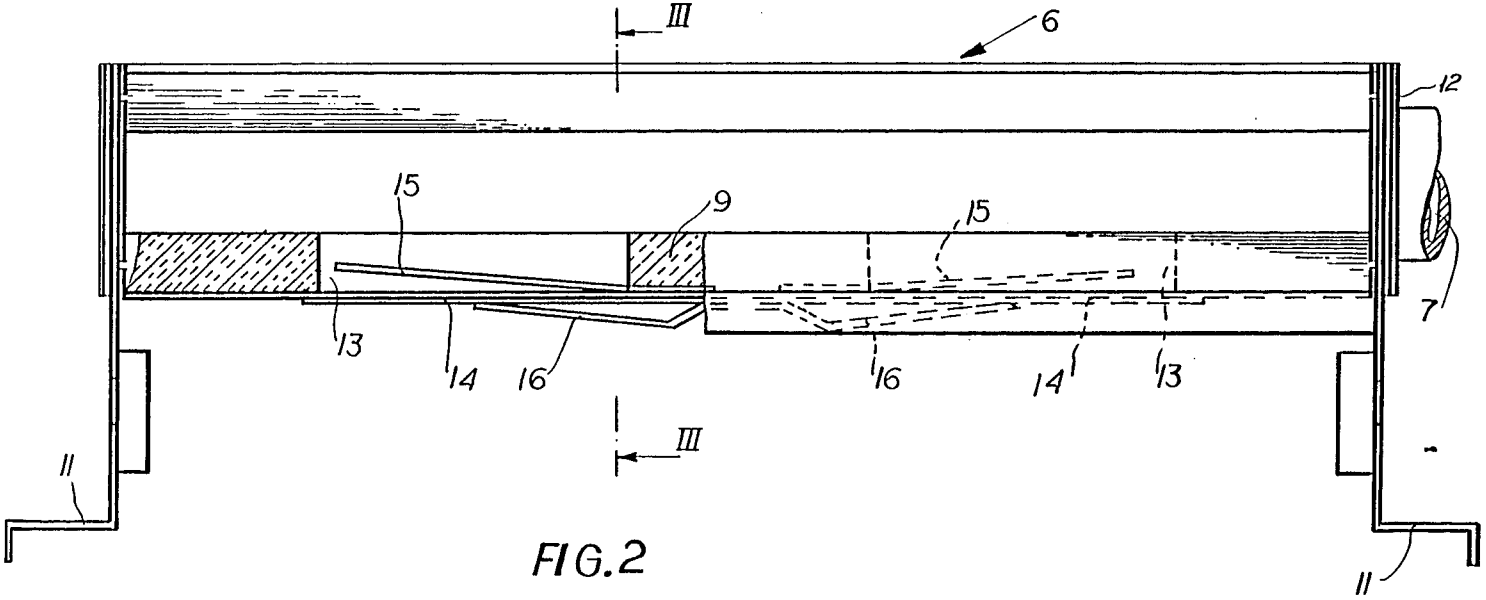
FIG. 2 is a top view of the exhaust gas duct.
Figure 3:
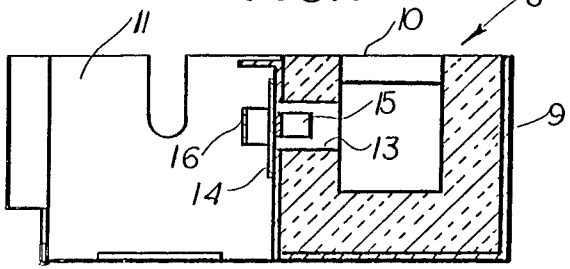
FIG. 3 is a cross section through the exhaust gas duct, taken along line III—III of FIG. 2.

The exhaust gas duct is a double walled structure made of sheet metal (FIGS. 2 and 3). The space surrounding it is filled with a heat insulating material. The exhaust gas duct 6 is open on its upper side 10 and is thereby configured as a trough.

The upper side 10 of the exhaust gas duct adjoins tightly the intermediate floor 2. The thermal barrier 3 made of mineral fiber covers the open upper side of the exhaust gas duct 6 and forms a seal around the surrounding edges. The exhaust gas channel is attached to the intermediate floor 2 and also to the range enclosure 1 by sheet metal corner pieces 11.

The exhaust gas duct extends across the entire breadth of the cooking range, and the chimney attachment aperture 7 is arranged on one face 12. Onto this chimney attachment aperture 7, a exhaust pipe can be attached, leading to a chimney (not shown).

FIGS. 2 and 3 depict the exhaust gas duct 6 as having two cool air openings 13 fitted with temperature-controlled closure elements 14. The closure element 14 is in the form of a closure flap, which covers the cool air opening when in the shut position and is attached to the outer side of the exhaust gas duct in a swivelable manner.

In the cool air opening 13, there is arranged a bimetallic spring 15, positioned so as to operate on the closure element 14.

As can be seen especially in FIG. 2, the bimetallic spring 15 is held movably opposite the closure element 14. The cool air opening 13 is larger than the bimetallic spring 15, so that its freedom of movement is assured at all temperatures without risk of deformation.

On the outer side of the closure element 14 there is a restoring spring 16 which is constructed as a sheet metal spring element, and this spring 16 exerts a slight pressure on the closure element 14. In this way, more reliable closure action is assured.

The cool air opening 13 is shown as a cool air slot, and the closure element 14 is positioned along the length of the long axis of the slot. The closure means is set so that the closure element 14 shuts at temperatures below a limiting temperature of about 80° C. which still affords a sufficient draft. At higher exhaust gas temperatures, the bimetallic spring 15 moves the closure element 14 and opens the cool air opening progressively, to an extent relating to the extent of the temperature excess in the exhaust gas duct 6.

By virtue of the reduced pressure in the exhaust gas duct, ambient air is drawn in and thereby lowers the exhaust gas temperature. The ambient air is drawn in through the floor of the cooking range which is normally a perforated floor. In this way, the inside space of the cooking range is also cooled, which has a beneficial influence on the lifetime of the controls normally located near the floor of the appliance.

In the best mode embodiment illustrated, two cool air devices 13 with their associated closure elements 14 are provided. The provision of more cool air openings 13 is required in cases where the exhaust gas duct is constructed in chambers, where each chamber is connected to a gas burner by way of an exhaust gas channel. In this case it is necessary to provide on each chamber a cool air opening 13 with its closure element 14.

The design of a exhaust gas duct in accordance with the invention achieves the result that the draft within the exhaust gas duct as well as in any attached exhaust pipe and/or chimney is not adversely disturbed during the lighting or warming up phase nor at low cooking levels. At the same time, it is assured that in steady operation, especially with the burners turned up full, the exhaust gas temperature cannot become excessive. The opening and flow characteristics can be predetermined by the choice of the bimetallic element and the shaping of the cool air openings in regard to size and geometry. The opening and flow characteristics are set so that an approximately constant flow velocity in the exhaust gas duct is obtained.

The thermally controlled exhaust gas duct of the invention can be used in other than gas fed cooking ranges, for example it can be used in a gas fed heater, or a kerosene fed cooking range.

We claim:

1. A cooking range comprising:

an enclosure;

an intermediate floor with thermal insulation thereupon in said enclosure, gas burners in said enclosure, a covering glass ceramic plate on said enclosure above said burners; and an exhaust gas duct with a exhaust opening, receiving exhaust gas from said burners;

said gas burners being located above the intermediate floor;

said thermal insulation being formed with exhaust gas outlet channels leading to the exhaust gas duct;

said exhaust gas duct having at least one cool air inlet opening provided with a closure element controlled in respect to the opening and closing of said cool air inlet by the temperature in said exhaust gas duct so that at temperatures below that at which a sufficient draft is produced said opening is closed and at higher temperatures said opening is progressively opened such that a substantially constant exhaust draft is maintained.

2. The cooking range defined in claim 1 wherein said closure element is constructed as a closure flap covering said opening when in closed position, and which is swivelably positioned on the outer side of said exhaust gas duct, and in said cool air opening a bimetallic spring is provided which exerts action upon said closure flap.

3. The cooking range defined in claim 2 wherein said bimetallic spring is held swivelably in said exhaust gas duct opposite said closure flap.

4. The cooking range defined in claim 1 where on an outer side of said closure element there is a restoring spring.

5. The cooking range defined in claim 1 wherein said cooling air opening is formed as a slot.

6. The cooking range defined in claim 1 where said exhaust gas duct is divided into segments, one segment for each of said gas burners, and where one of said cool air openings and one of said closure elements is provided for each of said segments.

7. The cooking range defined in claim 1 where the temperature in the exhaust gas duct is controlled to below about 80° C.

8. A cooking range comprising:

an enclosure;

an intermediate floor with thermal insulation thereupon in said enclosure, gas burners in said enclosure, a covering glass ceramic plate on said enclosure above said burners; and an exhaust gas duct with a exhaust opening, receiving exhaust gas from said burners;

said gas burners being located above the intermediate floor;

said thermal insulation being formed with exhaust gas outlet channels leading to the exhaust gas duct;

said exhaust gas duct having at least one cool air inlet opening provided with a closure element controlled in respect to the opening and closing of said cool air inlet by the temperature in said exhaust gas duct so that at temperatures below that at which a sufficient draft is produced said opening is closed and at higher temperatures said opening is progressively opened such that a substantially constant exhaust draft is maintained; and wherein said closure element is constructed as a closure flap covering said opening when in closed position, and which is swivelably positioned on the outer side of said exhaust gas duct, and in said cool air opening a bimetallic spring is provided which exerts action upon said closure flap, said exhaust gas duct is divided into segments, one segment for each of said gas burners, and where one of said cool air openings and one of said closure elements is provided for each of said segments, and on an outer side of said closure element there is a restoring spring.

* * * * *